US010222727B2

(12) United States Patent
Kawasaki et al.

(10) Patent No.: US 10,222,727 B2
(45) Date of Patent: Mar. 5, 2019

(54) IMAGE FORMING APPARATUS WHICH SUPPLIES COMPLEMENTING TONER TO A REGION BETWEEN FORMED TONER IMAGES IN WHICH NO TONER IS PROVIDED, AND NON-TRANSITORY COMPUTER-READABLE RECORDING MEDIUM STORING IMAGE FORMING PROGRAM

(71) Applicant: KONICA MINOLTA, INC., Chiyoda-ku, Tokyo (JP)

(72) Inventors: Tomohiro Kawasaki, Kanagawa (JP); Tetsuya Ishikawa, Kanagawa (JP); Hiroyuki Saito, Tokyo (JP); Ryoei Ikari, Saitama (JP); Tatsuya Furuta, Tokyo (JP); Aiko Kubota, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/728,776

(22) Filed: Oct. 10, 2017

(65) Prior Publication Data

US 2018/0113401 A1 Apr. 26, 2018

(30) Foreign Application Priority Data

Oct. 25, 2016 (JP) ..... 2016-208736

(51) Int. Cl.

| | |
|---|---|
| ***G03G 15/08*** | (2006.01) |
| ***G03G 15/20*** | (2006.01) |
| ***G03G 15/10*** | (2006.01) |
| ***G03G 15/00*** | (2006.01) |

(52) U.S. Cl.
CPC ..... *G03G 15/104* (2013.01); *G03G 15/2003* (2013.01); *G03G 15/2053* (2013.01); *G03G 15/6585* (2013.01); *G03G 15/6591* (2013.01)

(58) Field of Classification Search
CPC ..... G03G 15/104
USPC ..... 399/238
See application file for complete search history.

(56) References Cited

U.S. PATENT DOCUMENTS 9,482,980 B1 * 11/2016 Watanabe ..... G03G 15/0131

FOREIGN PATENT DOCUMENTS

| | | |
|---|---|---|
| JP | 2006078883 A | 3/2006 |
| JP | 2011197238 A | 10/2011 |

OTHER PUBLICATIONS

Computer translation of JP2006-078883A to Matsuura, published Mar. 2006.*

* cited by examiner

*Primary Examiner* — Quana M Grainger
(74) *Attorney, Agent, or Firm* — Holtz, Holtz & Volek PC

(57) ABSTRACT

An image forming apparatus includes: an image former that forms on a recording material a toner image based on input image information; a fixer that fixes a toner image formed on the recording material; and a hardware processor that controls the image former and the fixer in which the hardware processor controls the image former to supply, to a region where no toner is provided between toner images based on the input image information, complementing toner having a thermal conductivity higher than a thermal conductivity of toner for forming the toner image based on input image information.

20 Claims, 5 Drawing Sheets

IMAGE FORMING APPARATUS WHICH SUPPLIES COMPLEMENTING TONER TO A REGION BETWEEN FORMED TONER IMAGES IN WHICH NO TONER IS PROVIDED, AND NON-TRANSITORY COMPUTER-READABLE RECORDING MEDIUM STORING IMAGE FORMING PROGRAM

CROSS REFERENCE TO RELATED APPLICATIONS

Japanese Patent Application No. 2016-208736, filed on Oct. 25, 2016, including description, claims, drawings and abstract the entire disclosure is incorporated herein by reference in its entirety.

BACKGROUND

Technological Field

The present invention relates to an image forming apparatus and a non-transitory computer-readable recording medium storing an image forming program.

Description of the Related Art

In recent years, various sheets are used in electrophotographic image forming apparatuses (which include copiers, printers, facsimile machines, and multifunctional devices of these machines) that form a toner image on a sheet. To be more specific, in an image forming apparatus, not only typical sheets having a smooth surface (hereinafter referred to as smooth sheet), but also embossed sheets having irregularities on the surface are used as sheets on which to form images. Embossed sheets are used for the cover of printed materials, business cards, posters and the like, for example by utilizing the texture of various irregularities.

When printing is performed on an embossed sheet with an electrophotographic image forming apparatus, however, toner is buried in a recess in the sheet-cross sectional direction in a toner transferring step, and the adhesion between the toner buried in the recess and the fixing member is disadvantageously reduced in the subsequent fixation step.

To be more specific, in the case where printing is performed on the embossed sheet, an air layer is generated between the toner buried in the recess and the fixing member, and the heat transfer from of the fixing member is inhibited by the air layer. Consequently, the fixation performance is degraded, resulting in removal of toner, transfer (smear) of toner to another member, or the like.

Japanese Patent Application Laid-Open No. 2006-78883 (hereinafter, "Patent Literature (PTL)" 1) discloses a technique of reducing the surface roughness of the recording material by use of white and/or transparent toner before forming a color toner image based on input image information for the purpose of preventing density uneveness that is caused in printing on a recording material having a large surface roughness and having no gloss or the like such as an embossed sheet.

In the technique disclosed in PTL 1, however, the color toner is applied after preliminarily reducing the roughness (irregularities) of the recording material by filling the irregularities with transparent and/or white toner, and therefore it is impossible to improve the fixation performance of the color toner while maintaining the texture of the irregularities of the sheet.

To be more specific, with the technique disclosed in PTL 1, it is necessary to apply the color toner after the recess of the recording material is sufficiently reduced by use of transparent and/or white toner to improve the fixation performance of the color toner by reducing the air layer between the recess of the sheet and the fixing member. In this case, the color toner is applied to the surface of the sheet whose irregularities are reduced as much as possible with the transparent and/or white toner, and consequently the texture of the irregularities of the sheet is inevitably impaired, and it is necessary to use a large amount of the transparent and/or white toner.

SUMMARY

An object of the present invention is to provide an image forming apparatus and a non-transitory computer-readable recording medium storing an image forming program which can improve the fixation performance of the toner image while maintaining the texture of the irregularities of a sheet having a large surface roughness such as an embossed sheet.

To achieve the abovementioned object, an image forming apparatus reflecting one aspect of the present invention includes: an image former that forms on a recording material a toner image based on input image information; a fixer that fixes a toner image formed on the recording material; and a hardware processor that controls the image former and the fixer in which the hardware processor controls the image former to supply, to a region where no toner is provided between toner images based on the input image information, complementing toner having a thermal conductivity higher than a thermal conductivity of toner for forming the toner image based on input image information.

A non-transitory computer-readable recording medium storing an image forming program reflecting another aspect of the present invention is intended for a computer used by an image forming apparatus that forms on a recording material a toner image based on input image information, the image forming program being configured to cause the computer to supply, to a region where no toner is provided between toner images based on the input image information, complementing toner having a thermal conductivity higher than a thermal conductivity of toner for forming the toner image based on input image information, and fix a toner image and the complementing toner supplied to the recording material.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein.

DETAILED DESCRIPTION OF EMBODIMENTS

Hereinafter, one or more embodiments of the present invention will be described with reference to the drawings. However, the scope of the invention is not limited to the disclosed embodiments.

An embodiment illustrated and described below is an exemplary configuration of an image forming apparatus that detects irregularities (depressions) of an embossed sheet or the like having a large surface roughness, and performs an image formation process based on the detection result.

Figure 1:
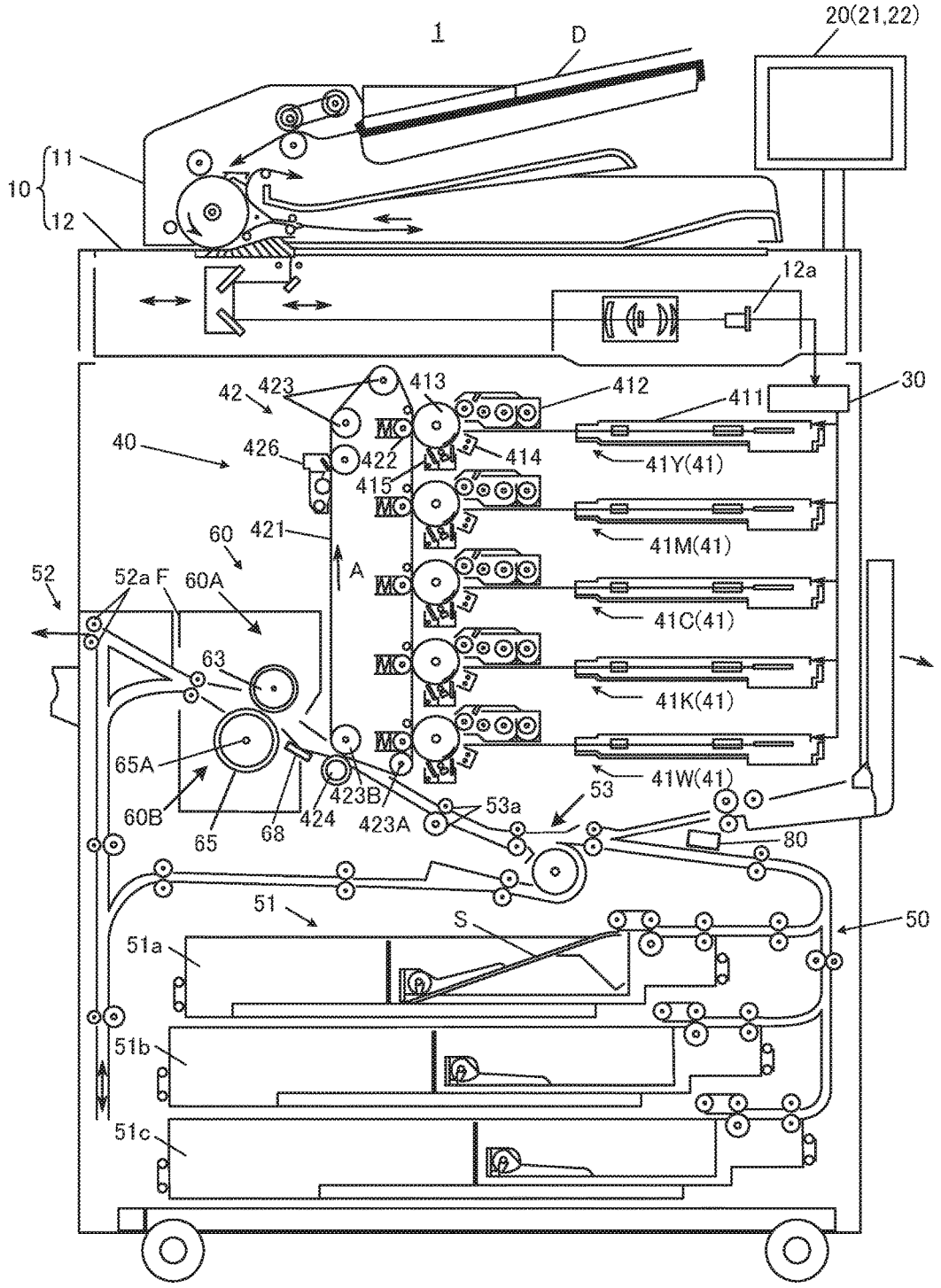
FIG. 1 schematically illustrates a general configuration of an image forming apparatus of an embodiment.
Figure 2:
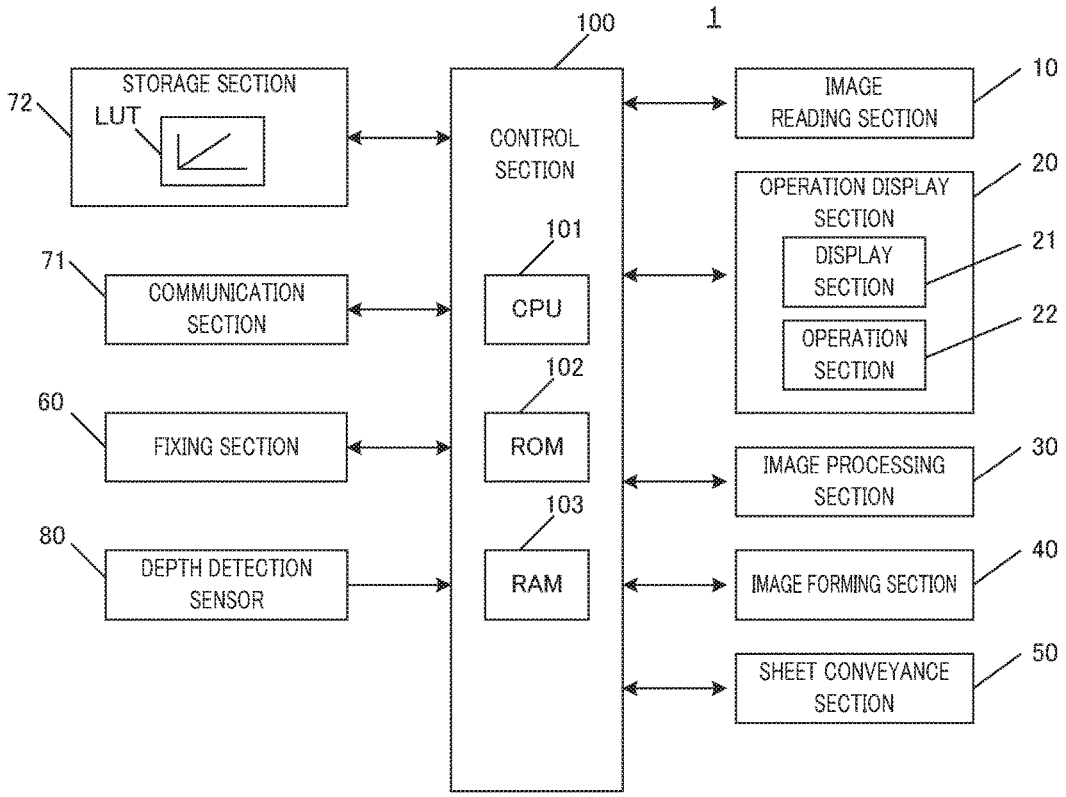
FIG. 2 illustrates a principal part of a control system of the image forming apparatus of the embodiment.

FIG. 1 illustrates an overall configuration of image forming apparatus 1 according to the embodiment of the present invention. FIG. 2 illustrates a principal part of a control system of image forming apparatus 1 according to the embodiment of the present invention. Image forming apparatus 1 illustrated in FIGS. 1 and 2 is a color image forming apparatus of an intermediate transfer system using electrophotographic process technology. That is, image forming apparatus 1 transfers (primary-transfers) toner images of yellow (Y), magenta (M), cyan (C), black (K), and white(W) formed on photoconductor drums 413 to intermediate transfer belt 421, and superimposes the toner images of the five colors on one another on intermediate transfer belt 421. Then, image forming system 1 secondary-transfers the resultant image to sheet S, thereby forming a toner image.

A tandem system is adopted for image forming apparatus 1. In the tandem system, photoconductor drums 413 corresponding to the five colors, YMCKW, are placed in series in the travelling direction of intermediate transfer belt 421, and the toner images of the five colors are sequentially transferred to intermediate transfer belt 421 in one cycle.

In the present embodiment, the toner of the four colors, Y (yellow), M (magenta), C (cyan), and K (black), is used as toner for forming a toner image based on input image data (input image information) on sheet S that is a recording material through intermediate transfer belt 421 that is an image bearing member. The toner of W (white) is used as complementing toner described later.

As illustrated in FIG. 2, image forming apparatus 1 includes image reading section 10, operation display section 20, image processing section 30, image forming section 40, sheet conveyance section 50, fixing section 60, depression depth detection sensor 80 and the like. It is to be noted that depression depth detection sensor 80 will be described later.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and operates to form a toner image on sheet S based on the image data (input image data). Communication section 71 is composed of, for example, a communication control card such as a LAN card.

Image reading section 10 includes auto document feeder (ADF) 11, document image scanning device 12 (scanner), and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and brings light reflected from the document into an image on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) provided with a touch panel, and functions as display section 21 and operation section 22. Display section 21 displays various operation screens, image statuses, operating conditions of each function, and the like in accordance with display control signals received from control section 100. Operation section 22 includes various operation keys such as numeric keys and a start key, receives various input operations performed by a user, and outputs operation signals to control section 100.

In the present embodiment, operation display section 20 functions as a region setting section for setting by the user the region to supply (or the region to be filled with) W (white) toner that is the complementing toner. The region setting section displays the entirety of the gaps generated between toner images based on input image data, or a depression region in the gaps generated between toner images based on input image data, as the region to supply the complementing toner in such a manner that the user can select the region. Then, the region setting section outputs the selection result of the user to control section 100 as region setting data.

In addition, operation display section 20 functions as a control content setting section for setting the control content of the image formation with control section 100. The control content setting section sets, in a selectable manner, the control content of a printing job using an embossed sheet as sheet S.

In the present embodiment, when the depth of the depression of the embossed sheet detected with depression depth detection sensor 80 is greater than a predetermined threshold, operation display section 20 indicates a display for determining whether to set a mode for reducing the consumption amount of W toner that is the complementing toner (hereinafter referred to as "toner consumption amount reduction mode") in a selectable manner for the user, and outputs the selection result to control section 100 as control content setting data.

In addition, in the present embodiment, when the basis weight set by a sheet setting profile not illustrated is greater than a predetermined threshold, operation display section 20 indicates the display for determining whether to set the toner consumption amount reduction mode in a selectable manner for the user, and outputs the selection result to control section 100 as control content setting data.

Image processing section 30 includes a circuit that performs a digital image process suited to initial settings or user settings on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: color image forming units (first toner formation units) 41Y, 41M, 41C, and 41K that form images of color toners of a Y component, an M component, a C component, and a K component on the basis of the input image data; intermediate transfer unit 42; and the like.

In addition, image forming section 40 includes complementing toner formation unit 41W for filling, with W toner (complementing toner), a predetermined region in the gaps where no toner is provided between color images (toner images) of YMCK color toners based on input image data, a detection result of depression depth detection sensor 80 and/or the like. In other words, complementing toner formation unit 41W functions as a second toner formation unit that forms a toner image composed of complementing toner in the region where no toner is provided between the toner images formed by first toner formation units 41Y, 41M, 41C, and 41K.

Color image forming units 41Y, 41M, 41C and 41K, and complementing toner formation unit 41W have configurations similar to each other. For ease of illustration and description, common elements are denoted with the same reference signs. Only when elements need to be discriminated from one another, Y, M, C, K or W is added to their reference signs. In FIG. 1, reference signs are given to only the elements of color image forming unit 41Y for the Y component, and reference signs are omitted for the elements of other units 41M, 41C, 41K, and 41W. In the following, units 41M, 41C, 41K and 41W are collectively referred to as toner formation unit 41, and common configurations are described.

Color image forming unit 41 includes exposing device 411, developing device 412, photoconductor drum 413, charging device 414, drum cleaning device 415 and the like.

Photoconductor drum 413 is a negative-charging type organic photoconductor (OPC) having photoconductivity in which an undercoat layer (UCL), a charge generation layer (CGL), and charge transport layer (CTL) are sequentially stacked on a peripheral surface of a conductive cylindrical body made of aluminum (aluminum raw pipe), for example. The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 100 controls a driving current supplied to a driving motor (not shown in the drawings) that rotates photoconductor drums 413, whereby photoconductor drums 413 is rotated at a constant circumferential speed. In the present embodiment, photoconductor drum 413 has a diameter of 60 mm, and is driven into rotation at a circumferential velocity of 315 mm/sec.

Charging device 414 evenly negatively charges the surface of photoconductor drum 413. Exposure device 411 is composed of, for example, a semiconductor laser, and configured to irradiate photoconductor drum 413 with laser light corresponding to the image of each color component. The positive charge is generated in the charge generation layer of photoconductor drum 413 and is transported to the surface of the charge transport layer, whereby the surface charge (negative charge) of photoconductor drum 413 is neutralized. An electrostatic latent image of each color component is formed on the surface of photoconductor drum 413 by the potential difference from its surroundings.

Developing device 412 is, for example, a two-component reverse development type developing device, and attaches the toners of respective color components to the surface of photoconductor drums 413 to visualize the electrostatic latent image, thereby forming a toner image.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is, for example, an endless belt made of polyimide resin (PI), and is disposed around a plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer section can be easily maintained at a constant speed. When driving roller 423A rotates, intermediate transfer belt 421 travels in arrow A direction at a constant speed.

Primary transfer rollers 422 are disposed on the inner periphery side of intermediate transfer belt 421 to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is, for example, a foamed urethane roller having a diameter of 25 mm, and is disposed to face backup roller 423B disposed on the downstream side in the belt travelling direction relative to driving roller 423A, at a position on the outer peripheral surface side of intermediate transfer belt 421. Backup roller 423B is, for example, a roller made of aluminum having a diameter of 30 mm. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to secondary transfer roller 424, and an electric charge of the polarity opposite to the polarity of the toner is applied to the rear side (the side that makes contact with secondary transfer roller 424) of sheet S, whereby the toner image is electrostatically transferred to sheet S. Sheet S on which the toner images have been transferred is conveyed toward fixing section 60.

Belt cleaning device 426 includes a belt cleaning blade made of a urethane rubber for example that is brought into sliding contact with the surface of intermediate transfer belt 421, and removes residual toner that remains on the surface of intermediate transfer belt 421 after the secondary transfer. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes upper fixing section 60A having a fixing side member disposed on a fixing surface (the surface on which a toner image is formed) side of sheet S, lower fixing section 60B having a back side supporting member disposed on the rear surface (the surface opposite to the fixing surface) side of sheet S, a heating source, and the like. The back side supporting member is brought into pressure contact with the fixing side member, whereby a fixing nip for conveying sheet S in a tightly sandwiching manner is formed.

In the present embodiment, fixing section 60 includes upper pressure roller 63 (having a diameter of 60 mm for example) provided with no heat source as a fixing side member of upper fixing section 60A, and lower heating roller 65 (having a diameter of 60 mm for example) in which heating source 65A such as a halogen heater is incorporated as a back side supporting member of lower fixing section 60B. Further, plate-shaped heating plate 68 such as a halogen heater for heating sheet S from below is disposed on the upstream side of lower heating roller 65 in the sheet conveyance direction, as a backup heating section.

At the fixing nip, fixing section 60 applies heat and pressure to sheet S on which a toner image has been secondary-transferred to fix the toner image on sheet S. Fixing section 60 is disposed as a unit in fixing part F. In addition, fixing part F is provided with an air-separating unit (not illustrated) that blows air to separate sheet S from the fixing side member.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 includes a plurality of pairs of conveyance rollers such as a pair of registration rollers 53*a*.

Sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet ejection rollers 52*a*.

Depression depth detection sensor 80 scans the surface of sheet S fed from sheet feeding section 51 and acquires depression information. Depression depth detection sensor 80 is, for example, an optical sensor, and includes light-receiving elements of a line CCD or the like and light-emitting elements arrayed in the width direction (the conveyance direction orthogonal to direction) of sheet S. Depression depth detection sensor 80 reads the light emitted from the light-emitting elements to the sheet surface with the light-receiving elements to detect the position and the depth of the depression of sheet S as depression information, and outputs the detected depression information to control section 100.

Conventionally, in the case where printing is performed on a sheet having depressions (irregularities) such as an embossed sheet with an electrophotographic image forming apparatus, the toner is buried in recesses of the sheet in the cross-sectional direction in a toner transferring step, and consequently the adhesion between the toner buried in the recess and the fixing member is disadvantageously reduced in the subsequent fixation step.

To be more specific, in the case where printing is performed on a sheet having a large surface roughness, an air layer is generated between the toner buried in the recess of the depression and the fixing member, and the heat transfer from of the fixing member is inhibited by the air layer, thus degrading the fixation performance. Such degradation in fixation performance results in removal of the toner from the sheet, transfer of the toner to the other members as a result of rubbing of the sheet with other members, or the like. Such problems are described in detail below with reference to the accompanying drawings.

Figure 3:
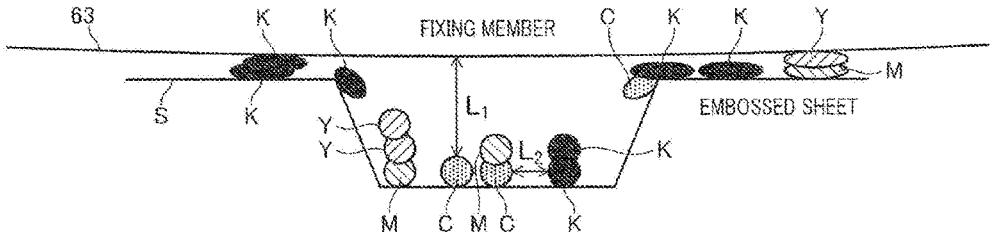
FIG. 3 PRIOR ART
FIG. 3 is an explanatory view of a state of an embossed sheet passing through a fixing section of a conventional image forming apparatus.

FIG. 3 is an explanatory view of a state of an embossed sheet passing through the fixing section in a conventional image forming apparatus. In FIG. 3, the black (K) toner is colored with black, and the cyan (C) toner, the magenta (M) toner, and the yellow (Y) toner are illustrated with respective hatchings. In addition, in FIG. 3, the fixing member (upper pressure roller 63) that makes contact with the toner is schematically illustrated on the upper side, and a cross-section of a depression portion (recess) of an embossed sheet (sheet S) having a depression is schematically illustrated on the lower side.

As illustrated in FIG. 3, the transferred YMCK toners are buried in the recess of the embossed sheet. In the region of the recess, the adhesion with the fixing member on the upper side is weak, and consequently an air layer is generated between the fixing member and the toners buried in the recess (see up-down arrow $L_1$), and, in the case of an image of a small toner amount such as a halftone image, an air layer is generated also between color toners as indicated with left-right arrow $L_2$. Such air layers have low thermal conductivities, and can possibly inhibit the heat transfer from the fixing section to the toners of Y, M, C, and K (hereinafter referred to also as "color toner"). In view of this, in the case where an image is formed in recesses of an embossed sheet or the like, the heat of the fixing section is not easily transferred to the color toner in the recesses, thus resulting in insufficient melting of the color toner.

When the melting of the toner is insufficient as described above, the toner is removed, or the toner is transferred to other places (the smear resisting property is degraded) when making contact with the members used in the steps after the fixation, or when rubbed with a large number of stacked sheets.

In view of this, in the present embodiment, in the image formation process, image forming section 40 is controlled such that the complementing toner is supplied to the region where no toner is provided between toner images based on input image data. In this example, when executing an image formation printing job, control section 100 controls image forming section 40 such that a gap between color toners is provided (complemented) with toner of another color (white) to fill the air layer whose heat conductivity is low with the white toner.

In the present embodiment, when executing an image formation printing job, control section 100 detects a gap region where no toner is provided between toner images based on input image data, and controls toner formation units 41Y, 41M, 41C, 41K, and 41W to supply white (W) toner to a predetermined region in the detected gap region. Here, the predetermined region to which the white (W) toner is supplied is set to include at least a region of a depression (recess) of a gap.

Figure 4:
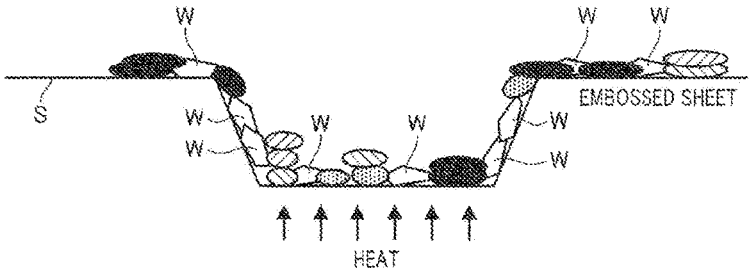
FIG. 4 is an explanatory view of a state of an embossed sheet passing through the fixing section of the image forming apparatus the embodiment, in which white toner is applied to the entirety of a gap between color toner images based on input image information.

FIG. 4 illustrates a state of an embossed sheet passing through fixing section 60 in the case where the above-mentioned control is performed. FIG. 4 illustrates a case where a color image identical to that of FIG. 3 is formed on an embossed sheet. In addition, in FIG. 4, the hatchings of color toners are identical to those of FIG. 3 and the reference numerals thereof are omitted, and, the fixing member is omitted for convenience of description. The same applies to FIG. 5 and FIG. 6.

In the present embodiment, by performing the above-described control, the air layers in the lateral direction (see arrow $L_2$ of FIG. 3) are filled with white (W) toner, and the air layers are eliminated or reduced as much as possible as can be seen from the comparison with FIG. 3. As a result, the heat of the fixing section is transferred to the color toner through the buried white (W) toner, and the melting of the color toner with heat is facilitated, thus facilitating the adhesion of the color toner to the sheet. In this manner, according to the present embodiment, improvement in the fixation performance of the color toner in fixing section 60 can be achieved.

In addition, according to the present embodiment, the state of the irregularities of the sheet can be maintained as much as possible, and accordingly the texture of the irregularities of the sheet is not impaired. In addition, according to the present embodiment, in comparison with the technique disclosed in PTL 1 in which the recesses of sheets are reduced in advance by use of white toner or the like, the consumption amount of the complementing toner (white toner) can be reduced.

FIG. 4 illustrates a state of an embossed sheet subjected to an exemplary control in which white toner is supplied to the entirety of the detected gaps between color toner images. In view of this, in the gap generated between color toner images, the white (W) toner is provided not only in the depression region (recess) of the sheet, but also in the plane region (protrusion) of the sheet.

Figure 5:
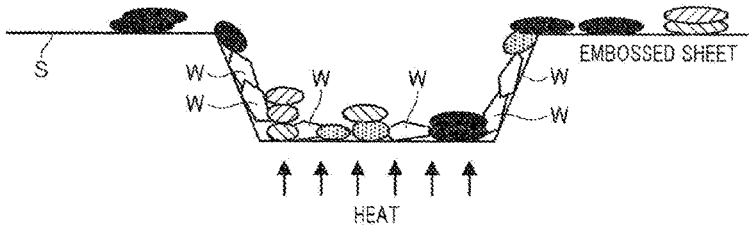
FIG. 5 is an explanatory view of a state of an embossed sheet passing through the fixing section of the image forming apparatus of the embodiment, in which white toner is applied to a region of a depression in a gap between color toner images based on input image information.

As another exemplary control, as illustrated in FIG. 5, control section 100 may control image forming section 40 to fill (complement), with toner of another color, only the depression region (recess) in the detected gaps between color toner images. In this case, the improvement in the fixation performance of the color toner can be achieved while further reducing the consumption amount of the toner for the complement.

Figure 6:
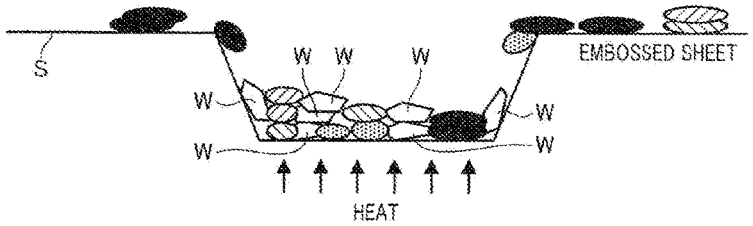
FIG. 6 is an explanatory view of a state of an embossed sheet passing through the fixing section of the image forming apparatus of the embodiment, in which white toner is applied by an increased amount per unit area to a region of a depression in a gap between color toner images based on input image information.

Further, as yet another exemplary control, the supply amount of the white (W) toner may be appropriately increased with the height of the color toner as the limit, as illustrated in FIG. 6. In this case, as can be seen from the comparison with FIG. 5, the air layers in the lateral direction in a sheet recess are reduced as much as possible up to the top position of the color toners. In addition, with this exemplary control, the length of an air layer of a recess of a sheet in the vertical direction, that is, the distance from the fixing member (see arrow $L_1$ of FIG. 3) can be reduced as can be seen from the comparison with FIG. 3 to FIG. 5. Accordingly, with this exemplary control, further improvement of the fixation performance of color toners can be achieved. Additionally, with this exemplary control, the height position of the white toner for complement does not exceed the height position of the color toners, and thus the irregularities of an embossed sheet or the like are maintained as much as possible, and, the texture of the irregularities can be maintained.

Here, preferably, the white toner that complements a gap between color toners is a toner having a thermal conductivity higher than that of color toners from the viewpoint of increasing the thermal conductivity and improving the fixation performance. To increase the thermal conductivity of the toner, a metal pigment having a high thermal conductivity may be contained, for example. In the present embodiment, as the metal pigment of the white toner, a pigment of titanium oxide (TiO) may be used. As an exemplary toner for increasing the thermal conductivity, a configuration containing a metal pigment, a binder resin, a fixation releasing agent, and a charging control agent may be adopted. Here, the content of the metal pigment may be 20 to 50 wt. %. With this configuration, when the thermal conductivity of the color toner is approximately 0.15 W/mK, the thermal conductivity of the white toner can be increased up to approximately 1.3 to 3.2 W/mK.

Figure 7:
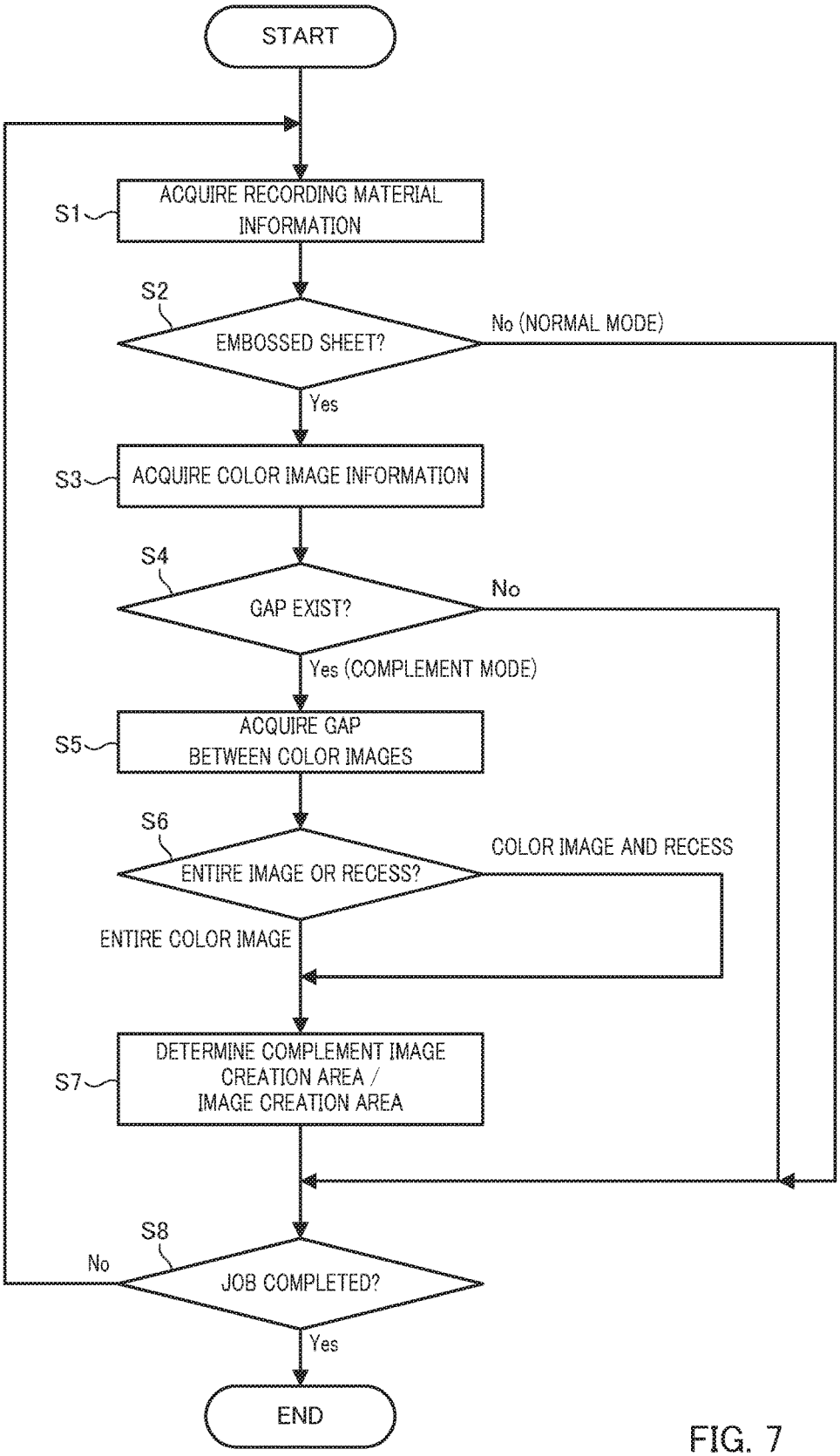
FIG. 7 is an exemplary flowchart of a control of the image forming apparatus of the embodiment.

An exemplary control of control section 100 for forming an image on an embossed sheet is described below with reference to the flowchart of FIG. 7.

At step S1, control section 100 acquires recording material information. Here, the recording material information is information of one sheet S to be subjected to printing, and, in the present embodiment, the information includes information of basis weight W set in a sheet setting profile and information of depression depth D obtained from depression depth detection sensor 80 after sheet feeding.

It is to be noted that, alternatively, the information of depression depth D may be associated with the information of the sheet type set in a sheet setting profile.

At step S2, control section 100 determines whether sheet S to be subjected to printing is an embossed sheet. In the present embodiment, whether the sheet is an embossed sheet is determined based on whether the value of depression depth D is greater than a predetermined threshold (for example, 30 μm). When control section 100 determines that the sheet to be subjected to printing is an embossed sheet (step S2, Yes), the process is advanced to step S3.

When control section 100 determines that the sheet to be subjected to printing is not an embossed sheet (step S2, No), control section 100 determines that the mode is a normal mode in which the complement of white (W) toner is not performed, and the process is advanced to step S8 by skipping the processes of step S3 to step S7.

At step S3, control section 100 acquires color image information from the input image data of the printing job. The color image information includes information on the type of color toners (YMCK) to be applied on sheet S to be subjected to printing, and information on the printing position on sheet S (the position on the sheet to which YMCK toners are applied).

At subsequent step S4, control section 100 analyzes the color image information acquired at step S3, and determines whether there is a gap between the color images to be printed. When control section 100 determines that there is a gap between the color images to be printed (step S4, Yes), the process is advanced to step S5. When control section 100 determines that there is no gap in the color image to be printed (step S4, No), the process is advanced to step S8 by skipping the processes of step S5 to step S7. For example, in the case of solid printing, it is determined that there is no gap in the color image.

At step S5, control section 100 acquires data of the gap between the color images, and the process is advanced to step S6. At step S6, control section 100 refers to the above-described region setting data, and selects the entire gap region of the color image, or only the region of the recess of sheet S in the gap region of the color image for application of complementing toner in accordance with the setting content set by the user, and the process is then advanced to step S7.

At step S7, in accordance with the selection result at step S6, control section 100 determines the region on sheet S to which the complementing toner is applied and the image creation condition (the fixing temperature and the like), and controls image forming section 40 and fixing section 60 in accordance with the determination result. At step S7, control section 100 can determine the region on sheet S to which the complementing toner is applied and the image creation condition (the fixing temperature and the like) by referring to the recording material information acquired at step S1. This exemplary control is described later with reference to FIG. 9.

At step S8, control section 100 determines whether the printing job is completed. When control section 100 determines that the printing job is completed (step S8, Yes), the process is terminated. When control section 100 determines that the printing job is not completed (step S8, No), the process is returned to step S1, and the processes are performed from step S1 for the next sheet S to be subjected to printing.

With image forming apparatus 1 that performs an image formation control with the above-described configuration, the fixation performance of the color image can be improved even with sheet S having a large surface roughness such as an embossed sheet. That is, according to the present embodiment, an air layer whose heat conductivity is low is filled with the complementing toner by applying the complementing toner to a gap between color toners in an image formation region, and thus the fixation performance of the color toner can be improved.

In addition, by use of a toner whose thermal conductivity is higher than that of the color toner as the complementing toner, the fixation performance of the color toner can be further improved.

In addition, since image forming apparatus 1 includes depression depth detection sensor 80 that scans the surface of sheet S and acquires depression information, various sheets such as an embossed sheet having non-periodic depressions can be used for printing.

In addition, in image forming apparatus 1, the complementing toner is applied only to the region of the depression (recess) in gaps between the color toners, and thus the consumption amount of complementing toner can be reduced.

In addition, with image forming apparatus 1, since a lower heating system that heats sheet S from below is adopted, the fixation performance of the color toner buried in the depression can be further improved. Additionally, since image forming apparatus 1 includes, at a position on the upstream side of lower heating roller 65 having heating source 65A in the sheet conveyance direction, heating plate 68 as a backup heating section that heats sheet S from below, the fixation performance of the color toner buried in the depression can be further improved.

Figure 8:
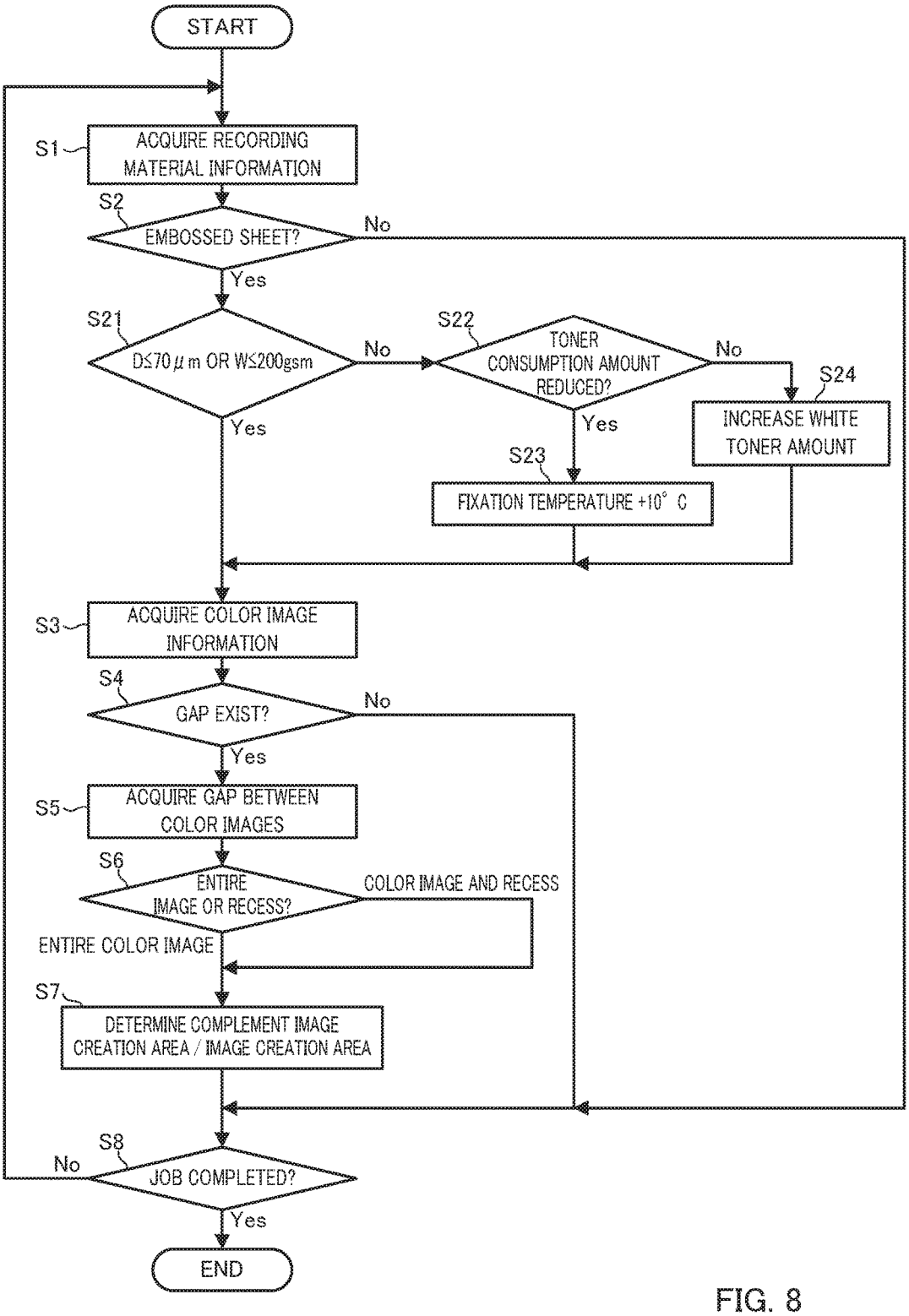
FIG. 8 is another exemplary flowchart of a control of the image forming apparatus of the embodiment.

FIG. 8 illustrates another exemplary flowchart of a control of image forming apparatus 1. This exemplary control illustrated in FIG. 8 additionally includes processes of step S21 to step S24 between the above-described processes of step S2 and step S3. Therefore, the processes described with reference to FIG. 7 are denoted with the same numbers and the description thereof is omitted.

In the exemplary control illustrated in FIG. 8, a process for ensuring the fixation performance of the image is performed when the depth of the depression of an embossed sheet that is sheet S to be subjected to printing is greater than a predetermined threshold, or when the basis weight of the embossed sheet is greater than a predetermined threshold.

At step S2, when control section 100 determines that sheet S to be subjected to printing is an embossed sheet (step S2, Yes), the process is advanced to step S21.

At step S21, control section 100 refers to the recording material information acquired at step S1 to determine whether the value of depression depth D is not greater than a predetermined threshold (for example, 70 μm), and whether basis weight W is not greater than a predetermined threshold (for example, 200 gsm).

When control section 100 determines that the value of depression depth D is not greater than the predetermined threshold (70 μm), and basis weight W is not greater than the predetermined threshold (200 gsm) (step S21, Yes), the process is advanced to step S3.

When control section 100 determines that the value of depression depth D is greater than the predetermined threshold (70 μm), or basis weight W is greater than the predetermined threshold (200 gsm) (step S21, No), the process is advanced to step S22.

At step S22, control section 100 refers to the above-described the control content setting data to determine whether the mode set by the user is the toner consumption amount reduction mode. When control section 100 determines that the mode set by the user is the toner consumption amount reduction mode (step S22, Yes), the process is advanced to step S23.

When control section 100 determines that the mode set by the user is not the toner consumption amount reduction mode (step S22, No), the process is advanced to step S24.

At step S23, control section 100 sets the fixing temperature to a temperature increased by a predetermined value (for example, 10° C.) as an image creation condition of applying complementing toner at step S7.

On the other hand, at step S24, control section 100 increases, to an amount corresponding to the height position of the color toner as described above with reference to FIG. 6, the amount of the complementing toner per unit area to be supplied to the region on the sheet at step S7.

Thereafter, at step S7, control section 100 determines the region on the sheet to which the complementing toner is applied and the image creation condition (the fixing temperature and the like) in accordance with the selection result of step S6, and the setting condition of step S23 or at step S24, and controls image forming section 40 and fixing section 60 in accordance with the determination.

With the exemplary control illustrated in FIG. 8, the fixation performance of the color toner can be maintained, or, improved by increasing the fixing temperature or by increasing the supply amount of the complementing toner per unit area in accordance with the depth of the depression (recess) of sheet S. In addition, with the exemplary control illustrated in FIG. 8, the fixation performance of the color toner can be maintained, or, improved in the case where a thick sheet having a large basis weight is used, by increasing the supply amount of the complementing toner per unit area, or by increasing the fixing temperature.

The W (white) toner is exemplified as the complementing toner in the embodiment. However, the color of the complementing toner is not limited, and may be other colors different from the color toner used for the image formation such as transparent, the color of the sheet, silver, and gold.

In addition, in the case where an image is formed on a black sheet for example, the black toner of image forming unit 41K may be used as the complementing toner. In this case, it suffices that the information on the sheet color is included in the recording material information by setting the sheet color in the sheet setting profile or the like, for example.

The color of the complementing toner that is applied to (complements) a gap of the toners used for image formation is not limited as long as the color does not impair the sheet color and the image formed on the sheet.

In the embodiment, the unit that supplies the complementing toner (second toner formation unit) is disposed on the downstream side of the units that supply the color (YMCK) toners in the sheet conveyance direction. However, the unit that supplies the complementing toner may be disposed on the upstream side of, or in the middle of, the units that supply the color (YMCK) toners in the sheet conveyance direction.

In the embodiment, the number of the unit that supplies the complementing toner is one. However, a plurality of units may be disposed for supplying the complementing toner, and the units may be used differently in accordance with the use.

The configuration and the control in the embodiment are set on the assumption that sheet S to be subjected to printing is an embossed sheet. However, the above-described configuration and control may also be applied to a case where sheet S to be subjected to printing is a recording material having a high surface roughness other than embossed sheets, or is a recording material having a smooth surface.

To be more specific, in the case where sheet S is a smooth sheet, when the thickness of the toner transferred onto sheet S is large, the melting of the toner is insufficient in the fixation process, and consequently removal of toner on sheet S, and/or transfer of the toner to other places may possible occur. With the image forming apparatus of the embodiment, even in the above-mentioned case, the melting performance of the toner used for image formation can be increased, and improvement in fixation performance can be achieved.

In the embodiment, cylindrical lower heating roller 65 of a lower thermal fixing type is adopted as the configuration for fixing the toner on sheet S, and heating plate 68 is used as the backup heating section on the upstream side of lower heating roller 65 in the sheet conveyance direction. The configuration for fixing the toner on sheet S is not limited to this, and, for example, a configuration of an upper thermal fixing type may be adopted.

In addition, heating plate 68 as the backup heating section may be disposed to face the sheet from the upper side. However, as described above, the lower thermal fixing type is preferable in the case of the configuration in which the toner is transferred from the upper side of sheet S.

EXAMPLES

Now examples in which the present invention is applied are described.

The present inventors conducted a test on the toner fixation performance in the case where toner images are formed on embossed sheets having various depression depths and basis weights with image forming apparatus 1 having the configuration of the embodiment. To be more specific, embossed sheets on which an image is formed were rubbed with another member (white paper sheet), and toner smudge (transfer) was checked. In the experiment, embossed sheets of 12 types, each of which has a basis weight of 150, 200, or 300 gsm, and a depression depth of 50, 60, 70, or 80 μm, were used.

In Example 1, an embossed sheet subjected to the exemplary control illustrated in FIG. 4, that is, an embossed sheet on which an image was formed such that the white toner was applied to (or the white toner filled) a gap between color toner images was tested. In Example 2, an embossed sheet subjected to the exemplary control illustrated in FIG. 5, that is, an embossed sheet on which an image was formed such that the white toner was applied to (complemented) a gap between color toner images and a depression (recess) of a sheet was tested. In Example 3, an embossed sheet subjected to the exemplary control illustrated in FIG. 6, that is, an embossed sheet on which an image was formed such that the white toner is applied by an increased amount to a gap between color toner images and a depression (recess) of a sheet up to the height position of the color toner was tested. In Example 4, an embossed sheet on which an image was formed such that white toner was applied to a gap between color toner images and a depression (recess) of a sheet (see FIG. 5), with a fixing temperature of the fixing section increased by 10° C. than usual was tested.

The conditions common to Examples 1 to 3 are as follows. The color toner image was set to four colors of YMCK, and the adhering amount on the sheet was set to 1.5 $g/m^2$. The adhering amount of the white toner on the sheet was set to 0.6 $g/m^2$. The particle size of each toner was set to 6 μm. A toner using a pigment of titanium oxide (TiO) was used as the white toner for the purpose of increasing the thermal conductivity.

In Example 4 in which an increased amount of the white toner was applied, the adhering amount of the white toner was set in accordance with Expression (1).

Adhering amount of white toner=adhering amount of color toner×(basis weight of embossed sheet÷300) ×(depression depth of embossed sheet÷80) (Expression (1))

In addition, as a comparative example, a configuration was tested in which white toner was not applied to a gap between color toner images or a depression (recess) of a sheet under the conditions same as those the above-mentioned Examples except that no white toner was applied.

(Indexes of Evaluation)

The printing surfaces of embossed sheets on which images were printed were rubbed with clean sheets (smooth sheets) as a test, and the degree of the smudge of the smooth sheet (hereinafter referred to as simply "paper") was evaluated before and after the test. To be more specific, the values of the smudge of the paper were calculated in accordance with Expression (2).

Smudge $\Delta L$ of paper=brightness $L$ of paper with smudges after test−brightness $L$ of paper before test (Expression (2))

Specific indexes of the evaluation are shown in Table 1.

TABLE 1

| Index | Evaluation | State |
|---|---|---|
| $\Delta L < 0.5$ | Good | Favorable with no smudge |
| $\Delta L < 1.5$ | Fair | Allowable with little smudge |
| $\Delta L < 4$ | Poor | Unacceptable with smudge |

As a result of calculation in accordance with Expression (2), ΔL smaller than 0.5 was determined to be favorable without smudge (good), ΔL equal to or greater than 0.5 and smaller than 1.5 was determined to be acceptable with little smudge (fair), and ΔL equal to or greater than 1.5 (maximum value: 4) was determined to be unacceptable with smudge (poor).

The experiment results of Examples 1 and 2 are shown in Table 2, and the experiment results of Examples 3 and 4 are shown in Table 3. In addition, the experiment results of Comparative example are shown in Table 4.

TABLE 2

(Examples 1 and 2)

| | Groove depth 50 | Groove depth 60 | Groove depth 70 | Groove depth 80 |
|---|---|---|---|---|
| Basis weight 150 | Good | Good | Good | Fair |
| Basis weight 200 | Good | Good | Fair | Fair |
| Basis weight 300 | Fair | Fair | Fair | Fair |

As shown in Table 2, in Examples 1 and 2, smudge was found on paper rubbed with embossed sheets having a basis weight of 300 gsm, embossed sheets having a depression depth of 80 μm, and embossed sheets having a basis weight of 200 gsm and a depression depth of 70 μm, although the degree of the smudge was acceptable.

TABLE 3

(Examples 3 and 4)

| | Groove depth 50 | Groove depth 60 | Groove depth 70 | Groove depth 80 |
|---|---|---|---|---|
| Basis weight 150 | Good | Good | Good | Good |
| Basis weight 200 | Good | Good | Good | Good |
| Basis weight 300 | Good | Good | Good | Good |

As shown in Table 3, in Examples 3 and 4, the results were favorable even with the embossed sheets on which smudge was found in Examples 1 and 2. Accordingly, it was confirmed that the fixation performance was improved in Examples 3 and 4 than Examples 1 and 2.

TABLE 4

(Comparative example)

| | Groove depth 50 | Groove depth 60 | Groove depth 70 | Groove depth 80 |
|---|---|---|---|---|
| Basis weight 150 | Poor | Poor | Poor | Poor |
| Basis weight 200 | Poor | Poor | Poor | Poor |
| Basis weight 300 | Poor | Poor | Poor | Poor |

As shown in Table 4, in Comparative example, the degree of the smudge was unacceptable in all embossed sheets.

OTHER EXAMPLES

In Examples 1 to 4, the tests were conducted with the embossed sheets of various depression depths and basis weights. The present inventors conducted the above-mentioned smudge test with smooth sheets of various basis weights as other examples and comparative examples. As a result, it was confirmed that the improvement in fixation performance of the color toner image was obtained also with the smooth sheets.

As described above, with an image forming apparatus and an image formation method adopting the present invention, the fixation performance of the toner image can be improved while maintaining the texture of the irregularities of sheets having a large surface roughness such as embossed sheets.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

an image former that forms, on a recording material, toner images based on input image information;

a fixer that fixes the toner images formed on the recording material; and a hardware processor that controls the image former and the fixer, wherein the hardware processor controls the image former to supply, to a region in which no toner is provided, the region being between the toner images formed based on the input image information, complementing toner having a thermal conductivity higher than a thermal conductivity of toner used to form the toner images based on the input image information.

2. The image forming apparatus according to claim 1, further comprising a depression information acquirer that acquires a position and a depth of a depression in the recording material as depression information, wherein the hardware processor refers to the depression information, and controls the image former to supply the complementing toner to at least a region of the depression in a gap between the toner images formed based on the input image information.

3. The image forming apparatus according to claim 1, wherein the image former includes:

a first toner former that forms the toner images based on the input image information; and a second toner former that forms a toner image composed of the complementing toner in the region in which no toner is provided between the toner images formed by the first toner former.

4. The image forming apparatus according to claim 2, further comprising a region setter that sets a region to which the complementing toner is supplied, wherein the region setter is capable of selecting an entirety of the region between the toner images formed based on the input image information, or the region of the depression in the gap between the toner images formed based on the input image information, as the region to which the complementing toner is supplied.

5. The image forming apparatus according to claim 2, wherein the hardware processor determines a supply amount of the complementing toner in accordance with the depth of the depression included in the depression information, and controls the image former based on the determination.

6. The image forming apparatus according to claim 5, further comprising a control content setter that sets a control content of the hardware processor in accordance with the depth of the depression included in the depression information, wherein the control content setter is capable of selecting a control of increasing the supply amount of the complementing toner in accordance with the depth of the depression included in the depression information, or a control of increasing a heating temperature of the fixer in accordance with the depth of the depression included in the depression information.

7. The image forming apparatus according to claim 1, further comprising a basis weight acquirer that acquires a basis weight of the recording material, wherein the hardware processor determines a supply amount of the complementing toner in accordance with the basis weight of the recording material, and controls the image former based on the determination.

8. The image forming apparatus according to claim 7, further comprising a control content setter that sets a control content of the hardware processor in accordance with the basis weight, wherein the control content setter is capable of selecting a control of increasing the supply amount of the complementing toner in accordance with the basis weight, or a control of increasing a heating temperature of the fixer in accordance with the basis weight.

9. The image forming apparatus according to claim 2, further comprising a sensor that scans a surface of a conveyed recording material to acquire the depression information, wherein the depression information acquirer acquires the depression information from the sensor.

10. The image forming apparatus according to claim 1, wherein the fixer includes a heating source disposed below a conveyed recording material.

11. The image forming apparatus according to claim 10, wherein:

the fixer includes an upper pressure roller and a lower heating roller including the heating source; and the image forming apparatus includes a backup heater that heats the recording material from below on an upstream side of the lower heating roller in a conveyance direction of the recording material.

12. The image forming apparatus according to claim 1, wherein the hardware processor detects, from the input image information, a gap region in which no toner is provided between the toner images, and controls the image former to supply the complementing toner to the detected gap region.

13. The image forming apparatus according to claim 1, wherein the complementing toner is a toner whose color does not impair a color of the recording material and the toner images.

14. A non-transitory computer-readable recording medium storing an image forming program for a computer used by an image forming apparatus that forms, on a recording material, toner images based on input image information, the image forming program being executable by the computer to control the computer to:

control the image forming apparatus to supply, to a region in which no toner is provided, the region being between the toner images formed based on the input image information, complementing toner having a thermal conductivity higher than a thermal conductivity of toner used to form the toner images based on the input image information; and control the image forming apparatus to fix the toner images and the complementing toner supplied to the recording material.

15. The non-transitory computer-readable recording medium according to claim 14, the image forming program being executable by the computer to further control the computer to:

acquire a position and a depth of a depression in the recording material as depression information; and refer to the depression information, and control the image forming apparatus to supply the complementing toner to at least a region of the depression in a gap between the toner images formed based on the input image information.

16. The non-transitory computer-readable recording medium according to claim 14, wherein the image forming apparatus includes:

a first toner former that forms the toner images based on the input image information; and a second toner former that forms a toner image composed of the complementing toner in the region in which no toner is provided between the toner images formed by the first toner former.

17. The non-transitory computer-readable recording medium according to claim 15, the image forming program being executable by the computer to further control the computer to set a region to which the complementing toner is supplied, the region to which the complementing toner is supplied being set as an entirety of the region between the toner images formed based on the input image information, or the region of the depression in the gap between the toner images formed based on the input image information.

18. The non-transitory computer-readable recording medium according to claim 17, the image forming program being executable by the computer to further set a control content of the computer in accordance with a depth of the depression included in the depression information, wherein the control content of the computer is set to a control of increasing a supply amount of the complementing toner in accordance with the depth of the depression included in the depression information, or a control of increasing a heating temperature of the fixer in accordance with the depth of the depression included in the depression information.

19. The non-transitory computer-readable recording medium according to claim 14, the image forming program being executable to further control the computer to determine a supply amount of the complementing toner in accordance with a basis weight of the recording material, and to control the image forming apparatus to supply the complementing toner based on the determination.

20. The non-transitory computer-readable recording medium according to claim 19, the image forming program being executable by the computer to further set a control content of the computer in accordance with the basis weight, wherein the control content of the computer is set to a control of increasing the supply amount of the complementing toner in accordance with the basis weight, or a control of increasing a heating temperature in accordance with the basis weight.

* * * * *